United States Patent [19]

Evälahti

[11] Patent Number: 4,988,408

[45] Date of Patent: Jan. 29, 1991

[54] APPARATUS FOR GUIDING WIRES OF A DOUBLE WIRE FORMER

[75] Inventor: Osmo Evälahti, Karhula, Finland

[73] Assignee: Valmet-Ahlstrom Inc., Karhula, Finland

[21] Appl. No.: 436,772

[22] Filed: Nov. 15, 1989

[30] Foreign Application Priority Data

Dec. 1, 1988 [FI] Finland ..... 885607

[51] Int. Cl.[5] ..... D21F 1/36

[52] U.S. Cl. ..... 162/301; 162/300; 162/352

[58] Field of Search ..... 162/300, 301, 303, 352, 162/374

[56] References Cited

U.S. PATENT DOCUMENTS

| | | | |
|---|---|---|---|
| 3,027,940 | 4/1962 | Dunlap | 162/352 |
| 3,595,105 | 6/1971 | Stuebe | 162/211 |
| 4,769,111 | 9/1988 | Nevalainen et al. | 162/301 |

FOREIGN PATENT DOCUMENTS

| | | |
|---|---|---|
| 3153305 | 3/1985 | Fed. Rep. of Germany . |
| 3406217 | 8/1985 | Fed. Rep. of Germany . |
| 3546629 | 8/1988 | Fed. Rep. of Germany . |
| 3503242 | 10/1988 | Fed. Rep. of Germany . |
| WO89/02499 | of 1989 | PCT Int'l Appl. . |

*Primary Examiner*—Karen M. Hastings

*Attorney, Agent, or Firm*—Nixon & Vanderhye

[57] ABSTRACT

The present invention relates to an apparatus for guiding the wires of a paper machine former. The former includes a double wire section including two wires (1,2) in parallel direction (R) in which on the other side of the wires (1,2) a dewatering unit (10) is arranged to drain water from the stock (3) flowing between the wires and in which at least the farthest wire (2) from the dewatering unit is compressed with foil lists (20) or equivalent support members against the wire (1) nearest to the dewatering unit (10) in cross-machine direction with respect to wire direction (R) and across the web width. The load of these foil lists (20) is achieved by separate pressurized load hose construction (21) arranged between each foil list (20) and support table or equivalent in order to achieve the desired press to the stock (3) between the wires (1,2). Each load hose construction (21) is, according to the invention, equipped with separate pressure spaces into which a desired overpressure can individually be conducted to achieve a desired foil list load against the wire leaning against the said foil list across the web width.

11 Claims, 4 Drawing Sheets

APPARATUS FOR GUIDING WIRES OF A DOUBLE WIRE FORMER

The invention relates to an apparatus for guiding the wires of a paper machine former. The former comprises a double wire section including two wires running parallelly in which on the other side of the wires a dewatering unit is arranged to drain water from the stock flowing between the wires and in which at least the farthest wire from the dewatering unit is compressed with foil lists or equivalent support members against the wire nearest to the dewatering unit in crosswise to wire direction and across the web width. The load of these foil lists or support members is achieved by separate pressurized load hose construction arranged between each foil list and support table or equivalent in order to achieve the desired pressure on the stock between the wires.

The paper machine former comprises as usual a double wire section in which top and bottom wire move in parallel with one another and stock is brought between the wires for drainage. In the dewatering unit, located above the top wire, underpressure prevails facilitating water removal from the stock. Bottom wire is normally supported with support foil lists to the support beam in cross-machine direction with respect to wire direction. The support beam is stationary with respect to the dewatering unit. It is desirable, in an apparatus such as this, that the gap between the wires is adjustable and that also the form of the gap is variable. For this purpose, several prior art solutions have been developed to guide and support wires.

DE publication No. 3406217, for example, discloses a guideway for a wire in which the bottom wire is supported by a plurality of foil lists located adjacent to one another and extending across the wire width. The bottom wire leans against these foil lists the said foil lists being adjustably pressed against the bottom wire. The foil lists mentioned in this solution are located very close to one another resulting in foil lists affecting one another with friction which then makes precise guiding difficult. DE publication No. 3153305 discloses a guideway for a wire in which there is a plurality of foil lists closely spaced leaning against the bottom wire. The press of these foil lists against the bottom wire is individually adjusted by means of a spring system. In a further prior art solution a load hose in cross-machine direction and extending across the web width is used as a spring system. This load hose is expanded with, e.g. compressed air, so that the desired foil list press against the bottom wire is achieved.

An essential disadvantage of the above-mentioned techniques is that the moisture of the web in cross-machine direction is not constant, but the cross-directional moisture has become such that the web moisture in the edge areas is higher than in the central area of the web. This is mainly caused by the fact that the foil list is loaded against the bottom wire mainly with uniform loading whereupon the foil list "floating" on the uniformly pressurized hose behaves so that twisting moment is present at the ends of the foil list due to points of discontinuity and this moment tends to bend the foil list. The uniform loading of the foil list has thus not resulted in a uniform pressure against the bottom wire across the whole web width.

The objective of the present invention is to improve the above-mentioned techniques as well as eliminate disadvantages connected to them. In order to accomplish this, the invention is mainly characterized in that each load hose construction is equipped with separate pressure spaces into which a desired overpressure can individually be conducted to achieve a desired foil list load against the wire leaning against the said foil list across the web width.

The most significant advantage of the present invention compared to the prior art techniques is that with the apparatus according to the invention a desired load is achieved to the foil lists leaning against the wire across the whole web width. Since the load can be adjusted to a desired level, also uniform press between the foil list and the wire is achieved, as a consequence of which peaks in the moisture profile can be cut out thus making the moisture profile even. Another significant advantage of the invention is that it can be applied to existing formers independent on whether the web between the wires moves horizontally, inclined or curved, and that the structure of the apparatus according to the invention is very simple and reliable. The other advantages and characteristics of the invention are given in the description below but within which the invention is not, however, limited.

BRIEF DESCRIPTION OF THE DRAWINGS

In the following the invention is described in detail with reference to the accompanying drawings.

FIG. 1 is a schematic side view of a double wire section of a paper machine former in which top wire 1 is arranged to move over guide rolls 6, 7, 8 and 9 and in which bottom wire 2 moves substantially in parallel with the top wire 1 below it. Wires 1 and 2 form a wedge-shaped gap 5 in which the stock 3 flowing on the bottom wire 2 is continuously pressed between wires 1 and 2 while they move. After the wedge-shaped inlet 5 in direction R there is a water removal section comprising a dewatering unit 10. The bottom 11 of the dewatering unit 10 is formed of top foil lists 12. There are slots between the top foil lists 12 through which water is evacuated from stock 3 into the dewatering unit 10 by underpressure. While moving, top wire 1 leans against the said top foil lists 12. Bottom foil lists 20 are arranged below dewatering unit 10, said foil lists applying pressure on the bottom wire 2 from below thus achieving the desired pressure to the stock below the dewatering unit 10. Additionally, FIG. 1 illustrates several other components and adjusting members of a former which are known per se and which will therefore not be described herein.

FIGS. 2 and 3 illustrate a former according to FIG. 1 more in detail covering the area of dewatering unit bottom 11 and lower foil lists 20 leaning against bottom wire 2. Further, FIG. 2 illustrates that this embodiment of the dewatering unit 10 comprises three chambers 10*a*, 10b, 10c in which underpressure prevails for draining water from stock 3 into the said chambers. Underpressure to and dewatering of chambers 10a, 10b, 10c is effected through pipes 26a, 26b, 26c. The chambers 10a, 10b, 10c are preferably underpressurized in different degrees. As stated above, the bottom 11 of the dewatering unit 10 is formed of top foil lists 12 which are in cross-machine direction with respect to direction R of wires 1 and 2 and against which the top wire 1 leans as it moves past the dewatering unit 10.

Figure 1:
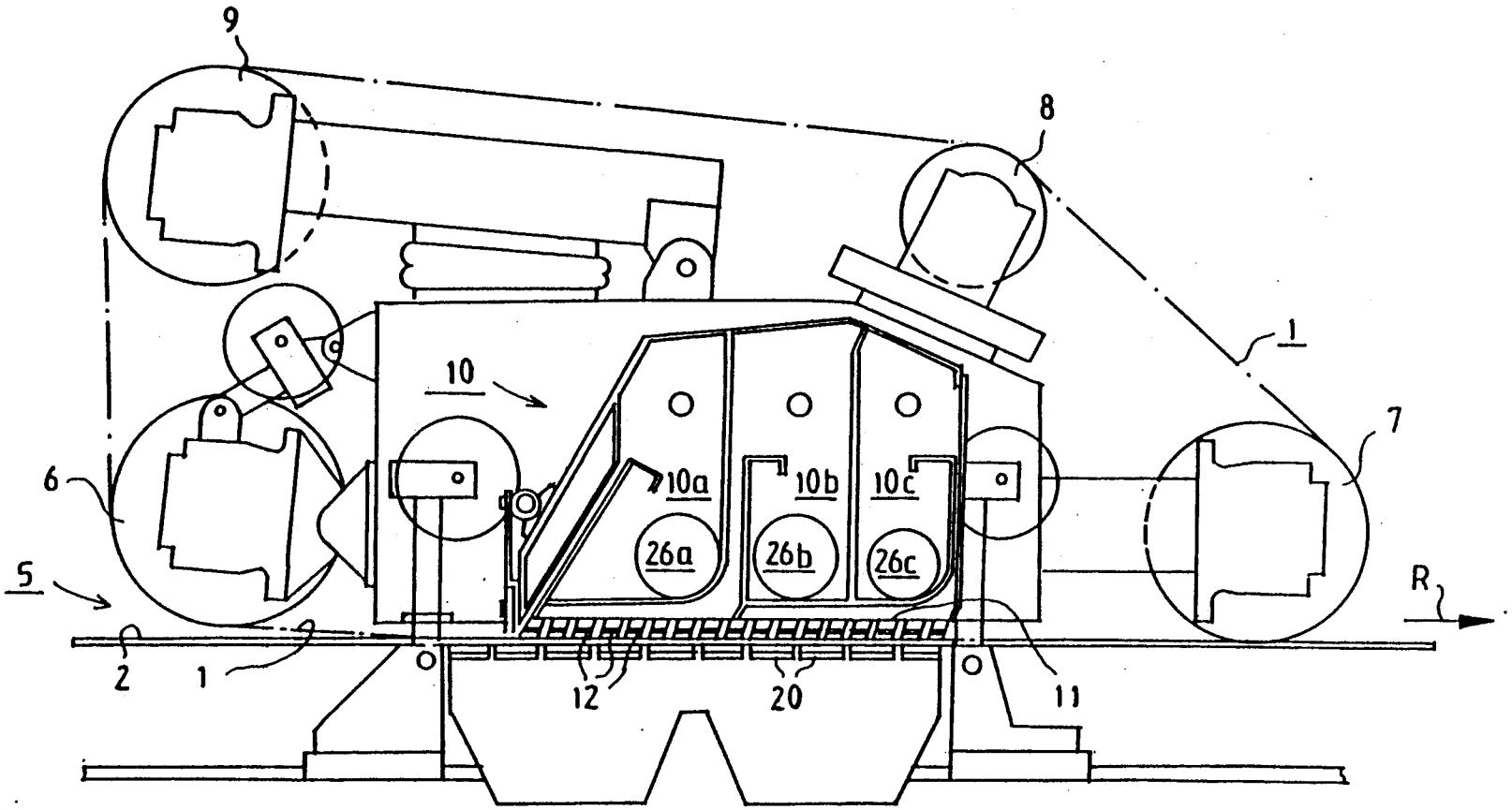
FIG. 1 is a schematic general side view of a former employing the apparatus according to the invention.
Figure 2:
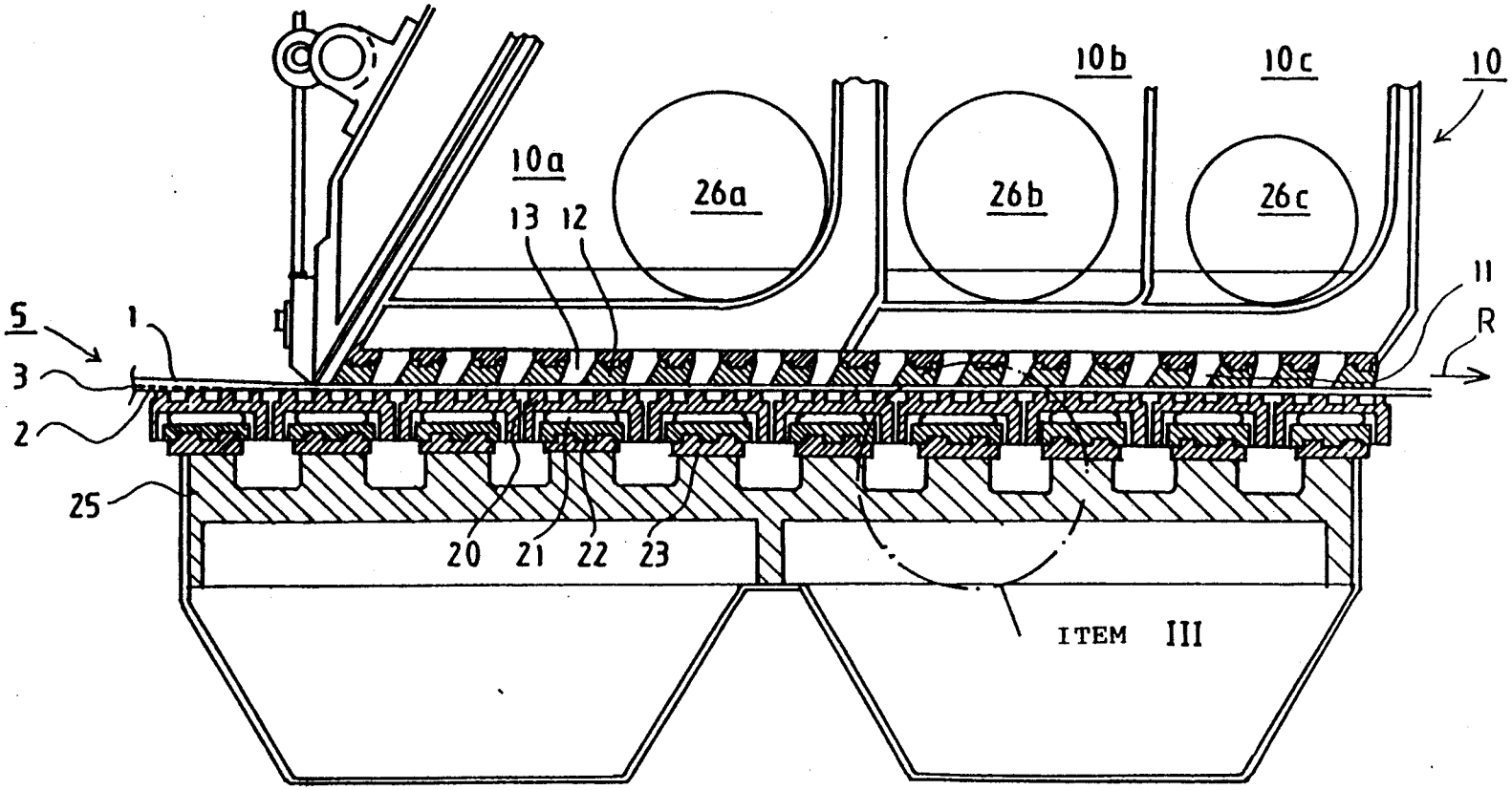
FIG. 2 is an enlarged detail of the dewatering unit in a former of FIG. 1 illustrating how the loading of the foil lists against the wire is arranged.
Figure 3:
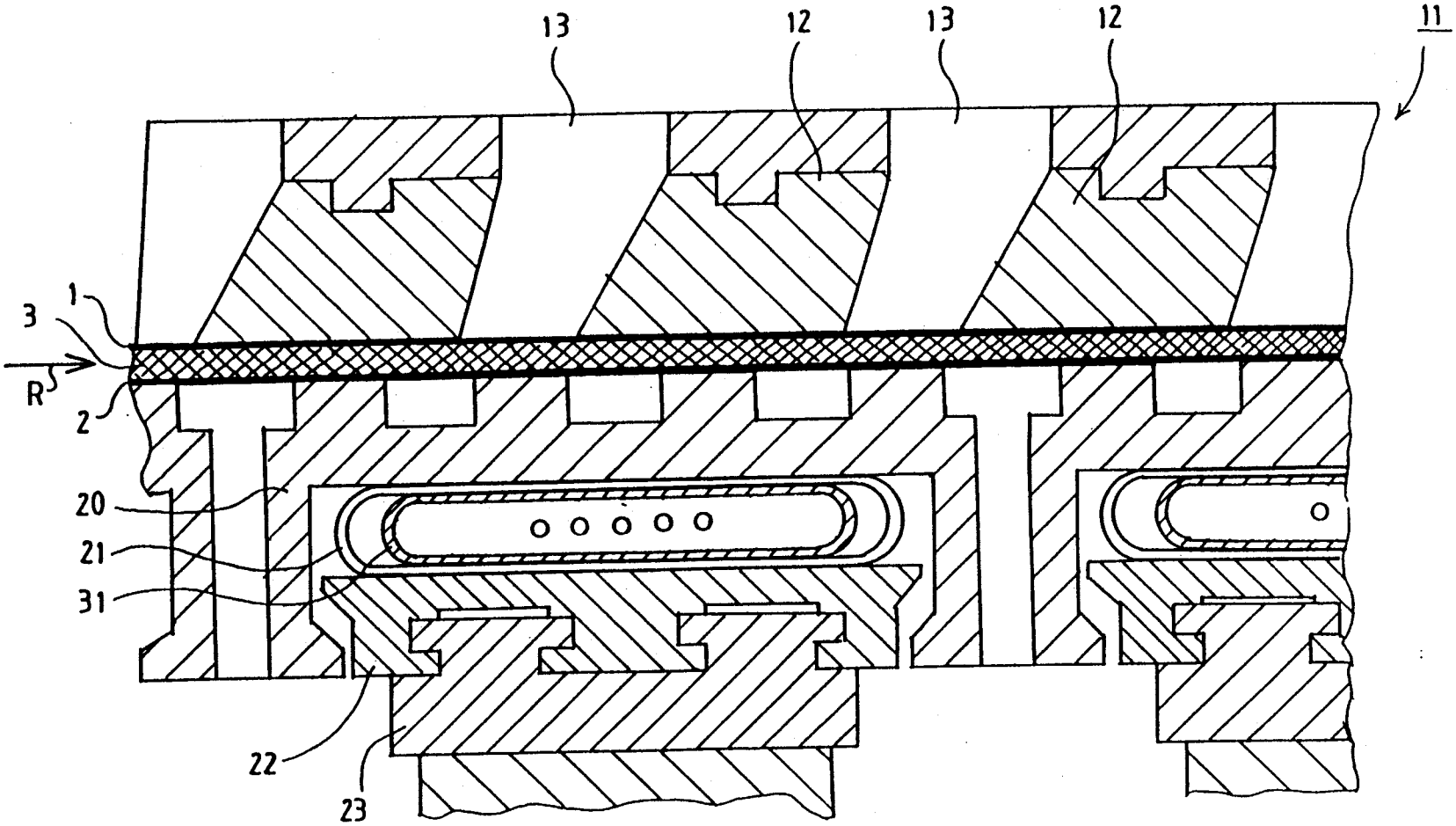
FIG. 3 is a further enlarged detail of point III in FIG. 2.

The said top foil lists 12 are arranged closely spaced in such a way that water channels 13 are formed between the top foil lists 12. The water is drained from stock 3 through water channels 13 into the dewatering unit 10. Bottom wire 2 is supported and loaded against top wire 1 in cross-machine direction with bottom foil lists 20 stretching across the web width, as mentioned previously. The loading of bottom foil lists 20 against top wire 1 is achieved by means of load hoses 21 arranged below bottom foil lists 20. These load hoses lie parallelly with bottom foil lists 20 and are loaded with, for example, compressed air in such a way that bottom foil lists 20 are pushed against the bottom surface of the bottom wire 2.

Figure 4:
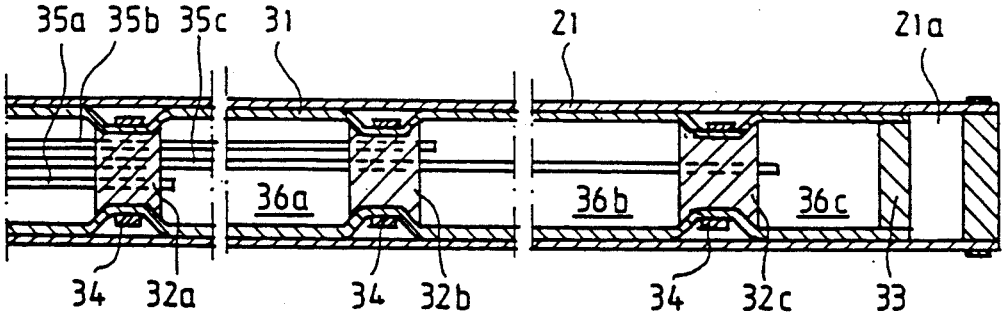
FIG. 4 is a schematic elevational cross-section view of the construction of a load hose.
Figure 5:
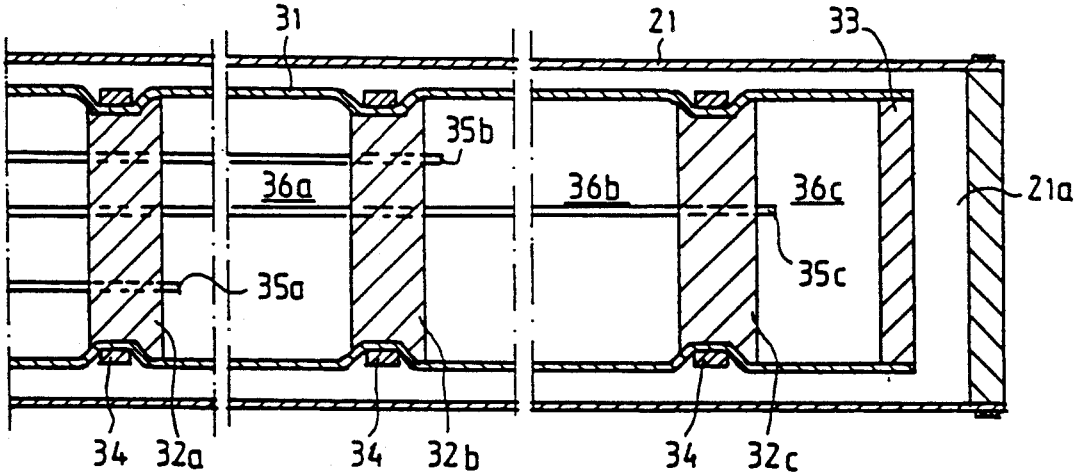
FIG. 5 is a schematic horizontal cross section view of the hose of FIG. 4.

As to the construction and operation of load hoses 21, special reference is made to FIGS. 4 and 5 which illustrate the construction of load hoses 21 more in detail. A rigid support table 25, stationary with respect to dewatering unit 10, is located under the dewatering unit 10 below bottom wire 2 and bottom foil lists 20. Support beams 23, in parallel with and below each bottom foil list 20, are installed in the said support table 25. Adjusting wedges 22 are arranged parallelly on the support beams 23. The said load hoses are arranged in the spaces between adjusting wedges 22 and bottom foil lists 20 in such a way that the overpressure prevailing in the load hoses pushes the bottom foil lists 20 upwards from the support table 25 against the bottom wire 2.

FIGS. 4 and 5 illustrate the construction of load hoses more in detail. FIG. 4 is a partial longitudinal elevational cross section view of the load hose construction and FIG. 5 is a partial longitudinal horizontal cross section view of an equivalent load hose construction. As illustrated in FIGS. 4 and 5, inner hoses 31 are arranged inside the load hoses 21, the pressure spaces of which are not connected to the pressure spaces 21a of load hoses 21. Inner hoses 31 are dimensioned to fill the pressure spaces 21a of load hoses 21 in vertical direction whilst the top and bottom surfaces of inner hoses 31 touch the inner surfaces of load hoses 21. In horizontal direction, however, the inner hoses 31 are substantially smaller than load hoses 21 so that there are spaces between load hoses 21 and inner hoses 31 which spaces function as pressure spaces 21a of load hoses 21. Overpressure of a determined degree is conducted to the said pressure space 21a. This overpressure is the basic pressure with which bottom foil lists 20 are loaded against bottom wire 2.

Inner hoses 31 are divided in longitudinal direction, i.e. cross-machine direction, into separate compartments by means of plugs 32a, 32b and 32c and end plugs 33. The said plugs 32a, 32b and 32c are arranged inside the inner hose 31 and fixed with e.g. a band 34 on the inner hose 31. The compartments between the plugs function as separate pressure spaces 36a, 36b and 36c into which overpressurized air is conducted e.g. by means of pipes 35a, 35b and 35c which are suitably conducted compactly through said plugs 32a, 32b and 32c. Pressure is thus conducted individually into each separate pressure space 36a, 36b and 36c of inner hose 31 by means of separate pipes 35a, 35b and 35c. Desired pressure is thus prevailing in each pressure space 36a, 36b and 36c of inner hose 31 so that pressures in different pressure spaces can substantially differ from one another.

The pressures of the said pressure spaces 36a, 36b and 36c can be changed and controlled in a desired manner so that the load on the bottom foil lists 20 achieved by load hose construction is adjusted on the desired level in the longitudinal direction of bottom foil lists 20. This arrangement thus affects the cross-directional load of the bottom wire 2, whereby the moisture profile of the stock 3 is balanced by means of an arrangement according to the invention. In adjacent bottom foil lists 20 the plugs 32a, 32b and 32c of inner hose 31 should be arranged overlapping so that the said plugs do not match in the wire direction R. Formation of streaks on the web 3 can be avoided with this arrangement.

Figure 6:
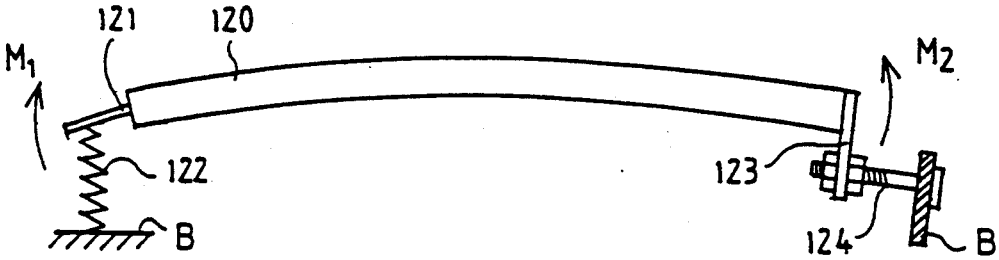
FIG. 6 is an alternative embodiment of how the foil list leaning against the wire is loaded uniformly.

FIG. 6 illustrates a further application of how to improve the balancing of the web moisture profile. As previously mentioned, the bottom foil list 120 floating on the pressurized load hose 21 behaves in such a way that a moment is formed at the ends of the foil list due to points of discontinuity and this moment tends to bend the bottom foil list 120. FIG. 6 illustrates two alternative ways to correct this bend. Both alternative solutions are based on an attempt to neutralize the moment bending the bottom foil list 120 by producing moments $M_1$ and $M_2$ opposite in direction to the ends of the bottom foil list 120. One alternative embodiment of this solution is to arrange e.g. a string member 122 or equivalent, which is supported by the bottom, at the end 121 of the bottom foil list 120. The said string member 122 raises the end 121 of the bottom foil list and produces moment $M_1$ which is opposite in direction with respect to the moment bending the bottom foil list 120. These string members 122 can be used at both ends of the bottom foil list 120. Another alternative embodiment is that moment $M_2$, opposite in direction, is produced to the end 123 of the bottom foil list 120 by means of screw member 124 or equivalent which is supported to the bottom B and which bends the bottom foil list 120 to the opposite direction. These screw members 124 can also be used at both ends of the bottom foil list 120.

The moisture profile can be corrected by means of the embodiments of FIG. 6 both in usual bottom foil list constructions loaded with load hoses 21 and in such constructions according to the invention in which an inner hose is arranged inside a load hose, as specifically described in connection with FIGS. 4 and 5. The disadvantage of the embodiment of FIG. 6 is that in practice it is difficult to adjust the value of the moments $M_1$ and $M_2$ produced at the ends of the bottom foil list 120. Additionally, in the double hose construction according to the present invention, additional correction of the bend of the bottom foil list 120 according to FIG. 6 is no longer needed.

The invention has been described above by way of example with reference to the accompanying drawings in which an ordinary former's double wire section is illustrated and wherein the wires run in horizontal direction and the dewatering unit is located above the wires and support members below the wires. The invention is, however, by no means limited to the examples illustrated in the figures but within the scope of the inventional concept defined by the appended patent claims also such solutions are possible wherein the wires run inclined or curved in the dewatering area or in which the dewatering unit is located below the previously mentioned bottom wire and "bottom foil lists" correspondingly above the top wire.

I claim:

1. A double wire section in the paper machine former comprising:

a dewatering unit which drains water from the stock flowing between top and bottom wires moving in parallel, said top wire being adjacent to said dewatering unit;

foil lists adjacent to said bottom wire for biasing said bottom wire against said top wire; an elongated load hose divided longitudinally into separate pressure spaces, comprising means for maintaining a desired pressure on said wire and indirectly on said stock by biasing said foil lists against said bottom wire;

said load hose comprising an elongated in a direction of elongation outer hose having a uniform pressure space and an inner surface, and a single inner hose extending longitudinally within said outer hose in the same direction of elongation and divided into said pressure spaces and having top and bottom outer surfaces and two sides in horizontal direction; said top and bottom outer surfaces of said inner hose being adjacent to and touching the inner surface of said outer hose such that said inner hose fills the outer hose in vertical direction, and said inner hose being smaller in the horizontal direction than said outer hose and defining said uniform pressure space between the inner hose and the outer hose at both sides of the inner hose in the horizontal direction.

2. Apparatus as recited in claim 1 further comprising: a plurality of plugs inside said inner load hose and separating said inner hose into said pressure spaces; and a band associated with each plug engaging the outer surface of said inner hose at said plug and thereby maintaining said plug within said inner hose.

3. Apparatus as recited in claim 2 further comprising means for supplying fluid under pressure into said pressure spaces, said means comprising a plurality of distinct pipes extending substantially parallel to said direction of elongation, a pipe terminating within each of said pressure spaces to supply fluid under pressure to the particular pressure space in which it terminates.

4. Apparatus as recited in claim 3 wherein each of said inner and outer hoses has an end termination, and wherein said end terminations are spaced from each other and are generally parallel to each other, and are generally perpendicular to said direction of elongation.

5. Apparatus as recited in claim 1 further comprising means for supplying fluid under pressure into said pressure spaces, said means comprising a plurality of distinct pipes extending substantially parallel to said direction of elongation, a pipe terminating within each of said pressure spaces to supply fluid under pressure to the particular pressure space in which it terminates.

6. Apparatus as recited in claim 1 wherein each of said inner and outer hoses has an end termination, and wherein said end terminations are spaced from each other and are generally parallel to each other, and are generally perpendicular to said direction of elongation.

7. Apparatus as recited in claim 2 wherein each of said inner and outer hoses has an end termination, and wherein said end terminations are spaced from each other and are generally parallel to each other, and are generally perpendicular to said direction of elongation.

8. Apparatus as recited in claim 6 further comprising means for supplying fluid under pressure into said pressure spaces, said means comprising a plurality of distinct pipes extending substantially parallel to said direction of elongation, a pipe terminating within each of said pressure spaces to supply fluid under pressure to the particular pressure space in which it terminates.

9. A double wire section in a paper machine former comprising:

a dewatering unit which drains water from the stock flowing between top and bottom wires moving in parallel, said top wire being adjacent to said dewatering unit;

means for biasing said bottom wire against said top wire, said means comprising foil lists biased against said bottom wire by a load hose separated into distinct pressure spaces and mounted between said foil lists and a support table, so that said load hose maintains a desired pressure on said second wire and indirectly on said stock; said load hose elongated in a dimension of elongation;

means for dividing said load hose longitudinally into said pressure spaces; and means for providing fluid under pressure to said individual pressure spaces, comprising a plurality of pipes, said pipes extending generally parallel to said load hose dimension of elongation and disposed therewithin, and passing through said means dividing said load hose into said pressure spaces, each pipe having an end termination, with a pipe end termination being provided in each of said pressure spaces to supply fluid under pressure from each pipe into the pressure space in which it has an end termination.

10. Apparatus as recited in claim 9 wherein said means for dividing said load hose into said pressure spaces comprises plug means extending substantially perpendicular to said load hose dimension of elongation, said pipes passing through said plug means.

11. Apparatus as recited in claim 10 wherein said load hose has a circumferential surface, and further comprising a band disposed around the circumferential surface of said load hose at each of said plug means, and for clamping said load hose to said plug means.

* * * * *